US007600378B2

(12) United States Patent
Yeghiazarian et al.

(10) Patent No.: US 7,600,378 B2
(45) Date of Patent: Oct. 13, 2009

(54) VOLUME PHASE TRANSITION TO INDUCE GEL MOVEMENT

(75) Inventors: Lilit L. Yeghiazarian, Los Angeles, CA (US); Ulrich Wiesner, Ithaca, NY (US); Carlo D. Montemagno, Los Angeles, CA (US)

(73) Assignee: Cornell Research Foundation, Inc., Ithaca, NY (US)

( * ) Notice: Subject to any disclaimer, the term of this patent is extended or adjusted under 35 U.S.C. 154(b) by 962 days.

(21) Appl. No.: 11/166,164

(22) Filed: Jun. 27, 2005

(65) Prior Publication Data

US 2006/0001010 A1 Jan. 5, 2006

Related U.S. Application Data

(63) Continuation-in-part of application No. 10/880,602, filed on Jul. 1, 2004, now Pat. No. 7,313,917.

(51) Int. Cl.
*F01B 29/10* (2006.01)

(52) U.S. Cl. ..... 60/527

(58) Field of Classification Search ..... 60/527–529
See application file for complete search history.

(56) References Cited

U.S. PATENT DOCUMENTS 5,354,264 A * 10/1994 Bae et al. ..... 604/21
5,643,247 A * 7/1997 Fernandez et al. ..... 604/891.1
6,524,274 B1 2/2003 Rosenthal et al. ..... 604/96.01
6,565,872 B2 5/2003 Wu et al. ..... 424/426
6,698,510 B2 3/2004 Serva et al. ..... 165/185
6,753,191 B2 6/2004 Asher et al. ..... 436/531
7,104,517 B1 * 9/2006 Derand et al. ..... 251/11
7,313,917 B2 * 1/2008 Yeghiazarian et al. ..... 60/527

OTHER PUBLICATIONS

Tanaka, T., et al., Reports—"Collapse of Gels in an Electric Field", Science, vol. 218, Oct. 29, 1982, p. 467-469.
Okajima, T., et al., "Kinetics of Volume Phase Transition in Poly(N-isopropylacrylamide) gels", J. Chem. Phys., vol. 116, No. 20, May 22, 2002, p. 9068-9077.
Z-6040 Silane Product Information—Dow Corning, 1997, 4 pages.
Joanny, J-F., et al., "Motion of an Adhesive Gel in a Swelling Gradient: A Mechanism for Cell Locomotion", Am. Phys. Soc., Review Letters, vol. 90, No. 16, Apr. 25, 2003, p. 168102-1-168102-4.
Ilavsky, J., et al., "X-Ray Scattering Studies of Structural Changes in Swollen Macromolecular Networks After Abrupt Temperature Changes", Undated, 2 pages.
Yeghiazarian, L., et al., "Directed Motion & Cargo Transport through Propagation of Polymer-Gel Volume Phase Transitions", Adv. Mater., DOI:10.1002/adma.200401205, p. 1-9, published on the internet May 25, 2005.

* cited by examiner

*Primary Examiner*—Hoang M Nguyen
(74) *Attorney, Agent, or Firm*—Bacon & Thomas, PLLC

(57) ABSTRACT

Movement of a gel structure is propagated by successively applying external stimuli to cause volume phase transition in the gel structure by alternately causing the gel structure to collapse and swell to move the center of mass of the gel structure in the direction of successive stimuli application. The movement is mediated by confining structure for the gel and anchoring the starting side of the gel in the swelling cycle.

3 Claims, 4 Drawing Sheets

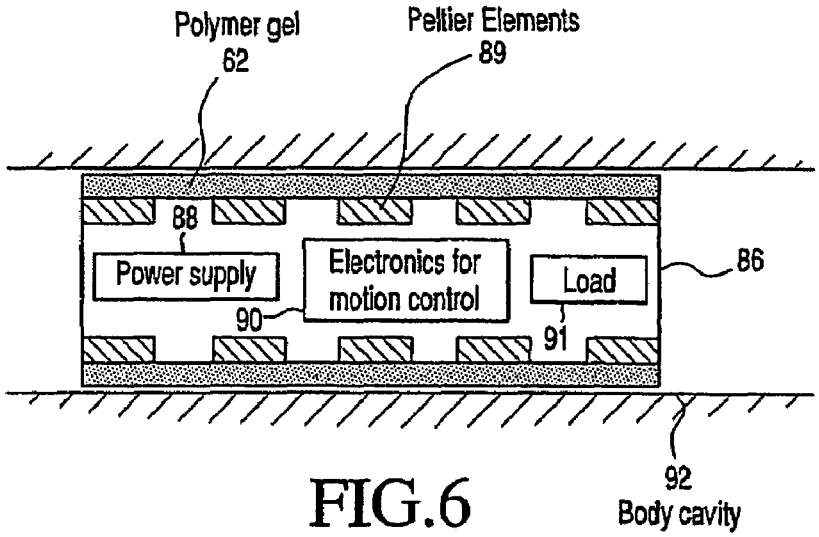
FIG.6
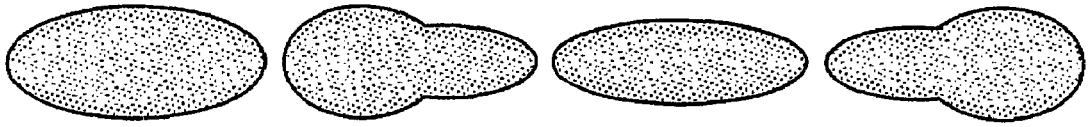
FIG.7A FIG.7B FIG.7C FIG.7D
FIG.7E
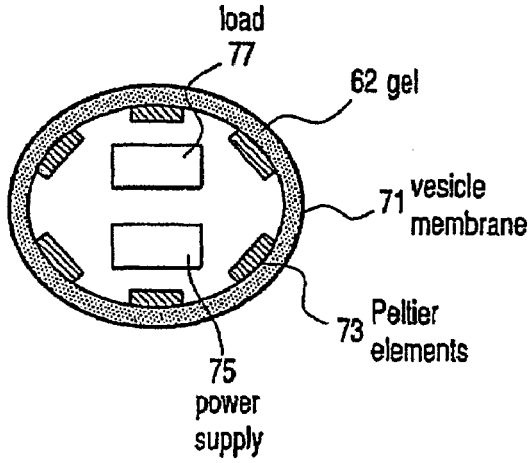

VOLUME PHASE TRANSITION TO INDUCE GEL MOVEMENT

CROSS-REFERENCE TO RELATED APPLICATIONS

This application is a continuation-in-part of U.S. application Ser. No. 10/880,602 filed Jul. 1, 2004.

This invention was made at least in part with Government support under Grant No. 2001-35102-09871 from the United States Department of Agriculture. The United States Government has certain rights in the invention.

TECHNICAL FIELD

This invention is directed at a method for propagating movement of a gel structure.

BACKGROUND OF THE INVENTION

Polymer gels consisting of cross-linked polymer networks immersed in a solvent are known to undergo reversible volume phase transitions upon small changes in the environment. See Tanaka, T., et al, Science 218, 467-469 (1982) and Okajima T., et al, J. of Chem. Phys. 20 (116), 9068-9077 (2002). However, this property has not heretofore been used to move the center of mass of the gel.

SUMMARY OF THE INVENTION

It has been discovered herein that applying two or more stimuli to alternately collapse and swell a confined gel structure in a predetermined sequence will cause movement of the gel structure in a desired direction. Initial expansion of a first section/segment/portion of a shrunken gel blocks the passageway of the confining structure and prevents subsequent expansion of an adjacent second section of the shrunken gel in that direction. Thus expansion of the second section applies a force against the blockage and occurs in the direction not obstructed by blockage and will move the center of mass of the gel structure away from the blockage. In effect, the expanding second section "pushes off" the blockage. The discovery has application in biotechnology, microfluidics (e.g., as pumps or transporters), robotics, drug delivery and cavity exploration (in humans or animals or other systems).

One embodiment of the invention herein denoted the first embodiment is directed to a method for propagating movement of an elongated gel structure having a first end and an other end and length and transverse dimensions, in the direction of its length, comprising applying one or more external stimuli starting at its first end and thereafter along its length to its other end, to cause a volume phase transition in the gel structure progressively along its length to move the center of mass of the gel structure in the direction of successive stimuli application. In other words, this embodiment involves application of one or more alternating stimuli in sequence to the gel to move it. Preferably the elongated gel structure has an aspect ratio of greater than 1 where the length dimension is greater than the transverse dimension, which, for example, ranges from 20 to 80.

In a first example of the first embodiment, the method comprises the steps of (a) providing an elongated confining passageway defined by at least one wall and having an entrance end and an exit end longitudinally removed from one another, and a transverse dimension; (b) providing in a minor portion of the passageway, preferably for practical purposes at or near its entrance end, a swollen reversibly collapsible gel structure, so that the gel structure is confined by said at least one wall and has a first end preferably at or near said entrance end of the passageway, e.g., within from 5 to 10 mm of said entrance end, and an other end longitudinally removed from said first end; (c) applying stimuli to the confined gel structure starting at its first end and then successively along its length to progressively induce a volume phase transition from said first end along the length of the gel structure to progressively collapse said gel structure and move the center of mass of the gel structure toward said exit end and provide a gel structure of reduced volume compared to that of step (b) having a first end longitudinally moved toward said exit end of the passageway and an other end longitudinally positioned about the same (since the progressive collapsing will induce some shrinkage also at said other end) as the other end in step (b) and having transverse dimension smaller than that of the confining passageway; (d) applying stimuli to the reduced volume gel structure at its moved first end to swell the moved first end in a transverse direction to anchor the gel structure to said at least one wall at said moved first end and also to swell the gel structure at the moved first end in a longitudinal direction and to move the other end of the gel structure toward the exit end of the confining passageway and successively applying stimuli along the length of the reduced volume gel structure to progressively induce volume phase transition to swell the gel structure along its entire length, thereby causing movement of the center of mass of the gel structure toward said exit end and optionally continuing the sequence of stimuli application. The direction of gel movement can be reversed when desired by reversing the direction of stimuli application. The initial state of the gel is not necessarily swollen; for example, the gel in the confining passageway can initially be in collapsed state and stimuli, e.g., cooling, applied in the desired direction of movement to swell it, whereupon movement is propagated by successively collapsing and swelling, etc., in said desired direction of movement. As is indicated above, the confining passageway both supports the gel structure and serves as a guiding track.

In one subset of the first example of the first embodiment, the passageway contains a piston abutting the first end or the other end of the elongated gel structure and movement of the center of mass of the gel structure toward said exit end, causes movement of the piston toward said exit end, and, if the piston is downstream of the gel structure or upstream but attached to it, movement of the center of mass of the gel structure away from said exit end causes movement of the piston away from said exit end.

In a second subset of the first example of the first embodiment, the gel structure has a drug entrapped therein which by movement of the center of mass of the gel structure is propelled from the passageway in the gel structure for introduction into a patient for controlled release of the drug into the patient.

In a third subset of the first example of the first embodiment, a load is appended to the gel structure by means of mechanical, physical or chemical attachment and is pushed or pulled through the passageway by movement of the gel structure.

In the first example of the first embodiment, the at least one wall is preferably the inner wall of a circular cross section tube.

In a second example of the first embodiment, said at least one wall comprises an outer rigid wall and an inner flexible wall of an annular structure and induction of volume phase transition moves the flexible wall so as to induce movement of a fluid through a central opening of the annular structure.

Another embodiment of the invention herein denoted the second embodiment is directed to pushing or pulling apparatus comprising (a) confining structure; (b) reversibly collapsible gel structure within the confining structure; (c) a load within the confining structure upstream or downstream of the gel structure; (d) stimulus applicator for causing collapsing and/or swelling of the gel structure; whereby operation of stimulus applicator progressively collapses and swells the gel structure to move the load.

Another embodiment herein, denoted the third embodiment, is directed to load moving apparatus comprising:

(a) a housing having an outer surface, (b) reversibly collapsible gel structure in moving causing or mediating relationship with the housing, (c) a load in the housing, (d) stimulus applicator in the housing for causing collapsing and/or swelling of the gel structure, whereby operation of the stimulus applicator successively and progressively causes collapsing and/or swelling of the gel structure to move the housing and the load.

In one alternative for the third embodiment, the housing is flexible and outer surface thereof is coated with the gel structure.

In a second alternative of the third embodiment, the housing is rigid and the gel structure is contained in flexible receptacles in engagement with said outer surface.

Another embodiment herein, denoted the fourth embodiment, comprises:

(a) a notched wheel, (b) a pawl having a notched wheel engaging end and an other end, (c) collapsible gel structure having one end attached to the other end of the pawl and other end for attachment to an immobile surface.

The gel structure works both as an engine and as a transporter of cargo. In a case where the gel structure acts as an engine it can be used as a piston causing negative pressure behind it. In a case where the gel structure acts as a transporter of cargo, it can be attached to or associated with a cargo.

The gel structure for the embodiments herein is preferably a polymer gel (i.e., a gel formed by crosslinking of a polymer, e.g., a hydrogel (a polymeric material which exhibits the ability to swell in water and to retain a significant portion of water within its structure without dissolution)) and very preferably is a poly-N-isopropylacrlamide hydrogel (PNIPAAm) or a PNIPAAm (with gel stiffening agent, e.g., polysaccharide, e.g., dextran added thereto) hydrogel or a nanocomposite hydrogel made from N-isopropylacrylamide as monomer and nanoclay, e.g., hectorite, and the stimuli to induce volume phase transition involving collapsing comprises application of a temperature above the lower critical solution temperature (LCST) and stimuli to induce volume phase transition involving swelling comprises application of a temperature below the LCST.

The transition conditions of a gel are the conditions under which the gel undergoes a phase transition, e.g., a volume phase transition. Where causing temperature change is the stimulus that causes phase transition, e.g., collapse and swelling of a gel, a gel is preferably selected where the transition temperature is within 15 degrees centigrade of room temperature. For poly-N-isopropylamide gels the transition temperature is about 33.5° C.

The term "volume phase transition" is used herein to mean a significant change in volume induced by a small change in the environment.

BRIEF DESCRIPTION OF THE DRAWINGS

FIG. 6 is a schematic representation of a device moving in a body cavity.

FIGS. 7A-7D constitute schematics showing a geometrical sequence of vesicle shapes that result in rectilinear self-propulsion.

FIG. 7E is a schematic representation of a gel coated vesicle for self-propulsion.

DETAILED DESCRIPTION

Figure 1:
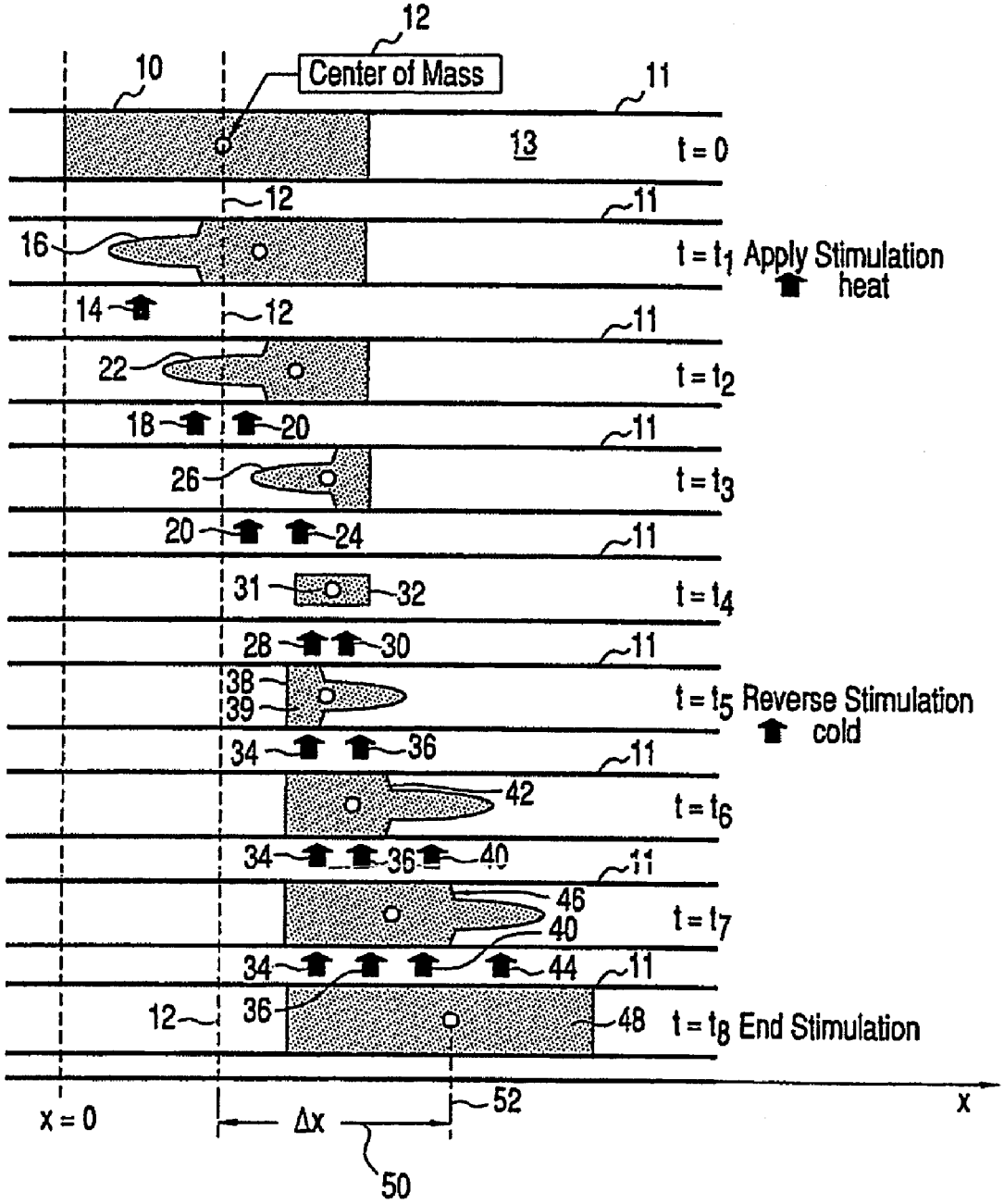
FIG. 1 is a schematic representation of progressive collapsing and swelling of a gel to move the center of mass of the gel in accordance with the first embodiment of the invention.

With continuing reference to FIG. 1, there is shown in schematic a series of volume phase transitions. A thermosensitive swollen gel structure is indicated at 10 for t (time)=0. The gel structure is confined in a tube 11. The center of mass of the gel structure at t=0 is indicated at 12. The portion of the tube not occupied by the gel structure is filled with water as shown at 13. For the experiment, the ends of the tube were sealed. At time=$t_1$ heating stimulus is applied at position 14 to cause rise of temperature in the adjacent gel structure to collapse and shrink a first portion of the gel structure as indicated at 16. The part of the gel in contact with the heating stimulus collapsed within seconds while the rest of the gel body remained unaffected. At t=$t_2$, heating elements at positions 18 and 20 are used to successively apply heat to the gel adjacent thereto to cause rise in temperature above the transition temperature to cause further shrinkage of the gel toward the other end of the gel as indicated at 22. At t=$t_3$ heating elements at positions 20 and 24 are used to successively heat the gel progressively along its further length to cause further collapse and shrinkage as indicated at 26 so as to provide at t=$t_4$ via successive application of heating elements at positions 28 and 30 a reduced volume gel structure 31 of reduced transverse dimension and shrinking in a longitudinal direction including a very small amount of shrinkage (not shown) at the end 32. At time=$t_5$, reverse stimulation successively at positions 34 and 36 (i.e. application of cold to reduce the temperature of adjacent gel structure below the transition temperature while the rest of the gel structure was kept at a temperature above the transition temperature of the gel) is applied to swell the gel as indicated at 39 both toward the left and toward the right and in the transverse direction to cause the gel structure moved first end to butt against the wall of confining structure 11 adjacent thereto to anchor the gel structure at end 38 against the confining structure 11 (caused by reverse stimulation at 34) and fill and block passageway of the confining structure in the vicinity of the anchoring so that further swelling and expansion (caused by reverse stimulation at 36) will move the gel structure other end and center of mass to the right. For example, with a gel structure with an aspect ratio of 50:1 longitudinal to transverse dimension, swelling to increase diameter 1 unit will increase the length 50 units. At $t=t_6$, further successive application of cold at positions 34, 36 and 40 causes further swelling to the right as indicated at 42. At $t=t_7$, further successive application of cold at positions 34, 36 40 and 44 to cause the temperature in the adjacent gel structure to fall below the transition temperature of the gel causes further swelling of the gel as indicated at 46 whereupon at $t=t_8$ the gel is fully swollen as indicated at 48 and stimulus in the form of reduction in temperature is terminated. The center of mass of the fully swollen gel 48 is at 52 whereby significant translational motion of the center of mass is obtained, the center of mass being moved a distance of $\Delta x$ as indicated at 50.

During the collapsing/swelling, the net volume of gel plus solvent (water) in the tube 11 in theory remains the same.

The stimuli are applied to propagate the volume phase transition along the gel structure beginning at the starting end of the gel structure and move the center of mass of the gel structure away from entrance end. The starting end defines the movement propagating direction which is in a direction away from the starting end of the gel structure toward the other end of the initial gel structure and, if desired, therebeyond.

A thermosensitive polymeric hydrogel used for demonstrating the concept of the invention herein was a thermosensitive poly-N-isopropylacrylamide gel (PNIPAA) prepared from 700 mM N-isopropylacrylamide monomer (NIPA) and 26 mM of N,N'-methylenebisacrylamide as the cross-linker as described in Okajima, T., et al J. of Chem. Phys. 116 (No. 20), 9068-9077 (5/2002). The poly-N-isopropylacrylamide gel used was a hydrogel, that is water was contained in the gel structure, and in the remainder of the tube. Alternatively other solvents can be used, if other gels are to be utilized.

Figure 9:
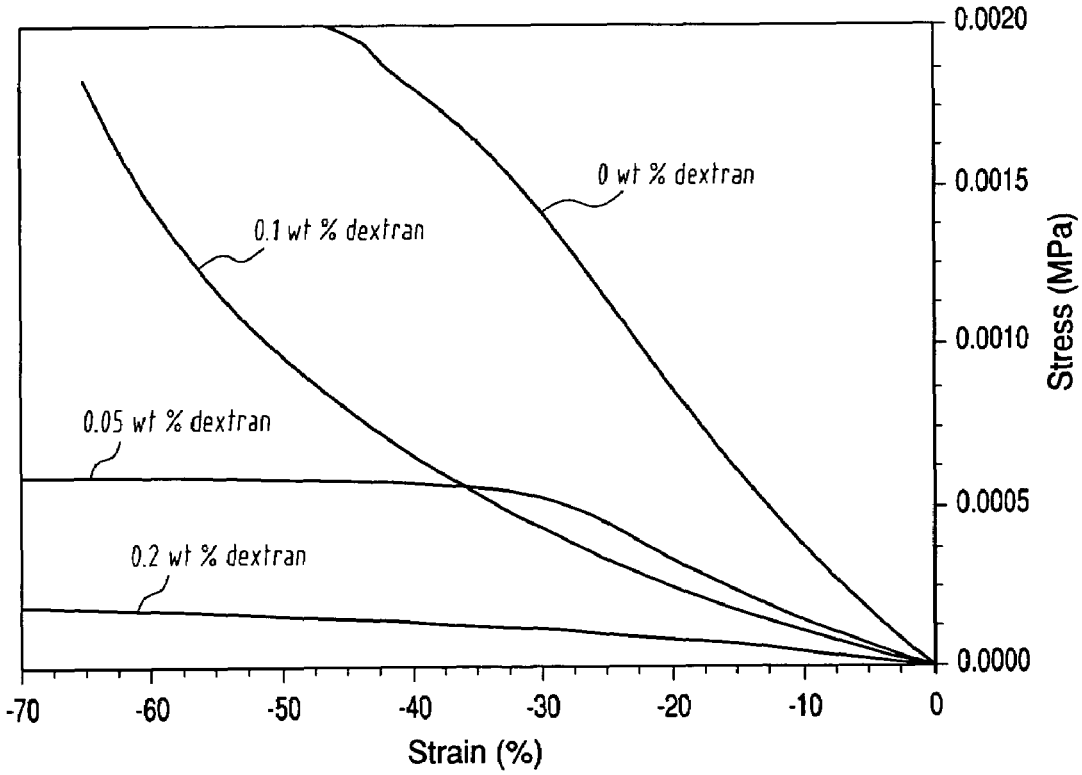
FIG. 9 is a graph of stress versus strain for samples with different dextran concentrations and shows results referred to later.

In another case stiffness (bending resistance) was added to the thermosensitive gel structure by adding stiffening agent, e.g., polysaccharide, e.g., dextran ($M_n$ ranging, for example, from 40,000 to 80,000). Compression testing results (Universal V3.9A TA Instruments) for 0% wt dextran, 0.05% wt dextran, 0.1% wt dextran and 0.2% wt dextran are shown in FIG. 9 hereto. Strain is indicated in FIG. 9 in negative values since it is determined under compression. The results show that the modulus (slope of the curve for stress-strain values) decreases as concentration of dextran increases indicating that dextran acts as a stiffener increasing the bending resistance of the gel. The stiffening agent, e.g., polysaccharide, e.g., dextran, is included in the gel in an amount of 0.02 to 0.25% by weight, e.g., from 0.05 to 0.20% by weight of the hydrogel.

In another case a thermosensitive hydrogel is a nanocomposite gel formed from N-isopropylacrylamide monomer and nanoclay (e.g., hectorite). Polymerization takes place around the clay particles and the clay acts as a crosslink between polymer chains. See Haraguchi, K., et al., Chem Phys Chem 6, 238-241 (2005). The nanocomposite has a transition which is not much different from a PNIPAAm hydrogel without clay. These nanocomposites are advantageous in generating higher forces on phase transition and are capable of retaining their initial state even after many heating/cooling cycles. Moreover the presence of the nanoclay increases modulus and provides strength.

While a thermosensitive gel structure was utilized, other gel structures undergoing reversible volume phase transition in response to temperature stimuli or other stimuli can be used. For example, partially hydrolyzed acrylamide gels in a solvent such as 50:50 acetone-water mixture which undergo reversible volume transitions upon small changes in temperature, solvent composition, pH, concentration of added salt, and application of electrical field across the gel, can be used for the invention herein.

Thus, the stimuli can be, for example, temperature change, solvent composition change, pH change, selective electrical field direction, and the like.

For thermosensitive gels of small volume, Peltier elements, e.g, 9×9 mm Peltier elements connected in parallel to a DC power supply can be used for stimuli application; these function as heat pumps and change the direction of heat transfer depending on the polarity of the DC voltage. In a test of the invention herein, a plurality of Peltier elements were used with each element being individually connected to the power supply through a switch. A paste, e.g. thermal conductive grease, may be applied to the outside of the confining structure, e.g., tube 11, for better heat conduction. For a smaller scale case, gold resistive heating elements are useful for causing increase of temperature above the transition temperature; cooling is a passive scenario.

An anti-stick compound is preferably coated on the inside of the confining structure so that the anchored swollen end of the gel structure does not become permanently attached. The anti-stick compound should make the wall of the confining structure that abuts the gel structure, hydrophobic. A suitable compound for this purpose is diethoxydimethylsilane coated on the inner tube surface as a dilute aqueous solution (0.1 to 0.5 percent silane concentration) by adjusting the pH of the water to 3.5 to 4.5 with about 0.1 percent acetic acid and then adding the silane and then stirring for about 15 minutes before the silane hydrolyzes and forms a clear homogenous solution and then applying the homogenous solution to the inner tube surface, and curing, preferably at 113° C. for at least 30 minutes.

In the experiments carried out, the confining wall was a glass tube of circular transverse cross-section. However, other transverse cross-section confining structures, e.g., square or rectangle or other tetragon, or trapezoid or other cross-section, can be used. The gels used in the experiments were 4.1 cm long and 0.7 mm wide in diameter, which makes the aspect ratio about 58.6; in a typical experiment, the center of mass of the 4.1 cm long gel moved along the gel by 3.3 cm with an average velocity of above 9.7 μm/sec by three cycles of shrinking and swelling. In the typical experiment, the shrinking and swelling times per segment were about one minute and less than five minutes, respectively.

Assuming that the volume change is fully reversible, the average velocity $V_{ave}$ of the center of mass of a gel can be approximated by the average velocity during one cycle of shrinking and one cycle of swelling as $$V_{ave} = \frac{L-1}{\tau_{sh}+\tau_{sw}} = \frac{1(m-1)}{d^2(m^2+1)} D_{diff} \tag{1}$$

where L is the length of the gel as it was polymerized, l is the length of the collapsed gel, $\tau_{SW}=D^2/D_{diff}$ and $\tau_{sh}=d^2/D_{diff}$ are the appropriate time scales for the shirnking and swelling of the gel, D is the as-polymerized diameter of the gel, d is the diameter of the collapsed gel, $D_{diff}$ is the average collective diffusion coefficient (approximately equal to $10^{-8}$ $cm^2s^{-1}$), m=L/l=D/d is the linear scaling ratio, and L/D=l/d is the aspect ratio of the gel. Note that the velocity is directly proportional to the length of the gel, and inversely proportional to the square of the diameter of the gel.

In order to initiate movement, only partial shrinkage or swelling of gels is sufficient. In addition, during a phase transition the rate of gel radius change is rapid in the beginning and then slows down. Therefore Equation 1 can be substituted by $$V_{ave} = \frac{L-1}{T_{sh}+T_{sw}} \quad (2)$$

where $T_{sh}$ is the time required to heat up (shrink) or cool down (swell) the gel and $T_{sh} \ll t_{sh}$ and $T_{SW} \ll t_{SW}$. $T_{sh}$ and $T_{SW}$ are chosen depending on the gel properties and the desired transport velocity, and can be varied depending on when the Peltier elements are turned on and off. From experimental data, the gel velocity during one full cycle (shrinking followed by swelling) has reached as high as 14.9 μm $s^{-1}$, with $T_{sh}$=240 s and $T_{SW}$=900 s. This is in very good agreement with the average velocity of 10.5 μm $s^{-1}$ calculated from Equation 2. In comparison one of the fastest crawling eukaryotes, *Acrasis rosea* amoebae (with a cell surface area of 759 $\mu m^2$), moves with an average speed of 71.6 μm $min^{-1}$. (See Zuppinger, C., et al., Eur. J. Protistol., 33, 396 (1990)) Among molecular motors, a translational velocity of 0.8 μm $s^{-1}$ was achieved in an elegant experiment by Limberis and Stewart, where 40 million kinesin motors transported a 10 μm×10 μm×5 μm silicon microchip along microtubule tracks. (See Nanotechnology 11, 47 (2000).

The transport capacity of micromachines is as crucial as their speed and control. Moving gels perform work that can be used for transporting cargo. The work is fueled by the difference between the gel free energies in the swollen and collapsed states. The total free energy of a polymer gel relative to the sum of the free energies of pure polymer network and pure solvent can be expressed as $$\Delta F = \Delta F - m + \Delta F_{el} + \Delta F_i \quad (3)$$

$$= kT[n\ln(1-\varphi) + \chi n\varphi] + \frac{3vkT}{2}(\alpha^2 - 1 - 1n\alpha) - vf\kappa T\ln\varphi$$

where $\Delta F_m$ is the mixing energy of the polymer network with solvent, $\Delta F_{el}$ is the elastic energy, and $\Delta F_i$ is the energy due to counterions for the ionic gels; n is the number of solvent molecules in the gel, ($\phi=\phi_0$ ($V_0/V$) is the volume fraction of the polymer network, $V_0$ is the as-synthesized gel volume, V is the gel volume, $\phi_0$ is the as-synthesized volume fraction of the polymer network, $\chi$ is the polymer-solvent interaction parameter, ν is the total number of chains in the gel, $\alpha=(V/V_0)^{1/3}$ is the linear swelling ratio, k is the Boltzmann constant, T is the absolute temperature, and $f$ is the number of counterions per chain.

The maximum amount of free-energy change of a 4 cm long, 0.7 mm diameter nonionic NIPA gel with a shear modulus of $10^4$ Pa as it shrinks to 0.38 of its original volume during a phase transition is approximately 0.5 J (with $n=4.8\times10^{22}$ before the gel transition, $n=1.5\times10^{22}$ after the gel transition, $\nu=2.9\times10^{15}$, $\chi=0.5$, $\phi_0=0.08$, $V_0=1.54\times10^{-8}$ $m^3$, $V=0.38\ V_0$, and T=306.8 K). However, most of this energy is an energy of mixing that is dissipated in the form of heat. Only the elastic contribution, the second term in Equation 3, is recoverable energy and is of the order of $10^{-6}$ J for the gel of the experiment. This energy can be used to propel the gel forward and to drag any cargo. We have demonstrated the cargo-transport capacity of polymer gels by bonding a glass bead with a diameter of 0.6 mm to the end of the gel and observing its transport during the shrinking phase of the anisotropic volume phase transition. The work required to drag such a bead in unbounded water for a distance of 18 mm corresponding to one collapse and swelling cycle of the gel and at the average velocity calculated above is only of the order of $10^{-11}$ J.

There is a maximum speed achievable for a gel with a given length/diameter ratio. Because the collapse of successive portions of the gel (by turning on successive heating elements) must produce enough energy to move the already-collapsed portion of the gel plus a cargo, there will be a limitation to the simple results of Equations 1,2. As one progresses into the collapse of a gel along its length, there will be a slowing down of the average velocity due to the increase of the length of gel that has to be moved through the liquid medium. A calculation of the maximum velocity achievable by a cylindrical microgel entails calculating the drag on collapsed portion of the gel and balancing the work needed for motion with the elastic energy released by a segment of the gel under collapse. For a gel of a given diameter, as the gel length increases, the average velocity decreases once the elastic energy of collapsing segments is no longer sufficient to pull the gel and a cargo. It can be anticipated, nonetheless, that for a microgel of the same L/D ratio as our experimental gel, we would be able to achieve velocities higher by orders of magnitude.

The time scale for temperature change in these hydrogels is always much smaller than the time scale of volume change. This is because the thermal diffusion time $\tau_{heat}=d^2/\alpha$, where $\alpha$ is the thermal diffusivity of the gel, is much faster than $\tau_{SW}$ or $\tau_{sh}$. Therefore, the heat transfer should not be an issue in scaling down a device such as the one presented here.

Figure 2:
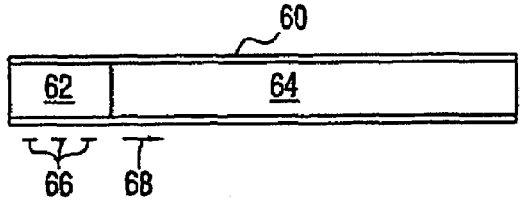
FIG. 2 is a schematic representation of a longitudinal cross-section of a tube containing a gel structure and the application of volume phase transition.

With reference to FIG. 2, there is depicted a glass tube 60, containing a PNIPAA hydrogel 62 at one end and a body of water 64 in the rest of the tube. Peltier elements 66 are schematically shown at the left end of the tube and the arrow 68 schematically indicates Peltier elements along the length of the tube and switched on successively in the direction of the arrow. The first of Peltier elements adjacent the hydrogel, are wired to cause heating. The next set of Peltier elements adjacent the hydrogel, are wired to cause cooling. Volume phase transition is induced at the first end of gel structure 62 by heating up the faces of the first one or two elements. The part of the gel adjacent to the hot elements collapses within seconds, while the rest of its body remains unaffected. As the gel shrinks from one end, its center of mass moves toward the other end. The next 1 or 2 elements are then heated and so on until the entire gel collapses leading to significant transitional motion of the center of mass in one direction. The element or elements used should be of sufficient length for the purpose desired. After the gel is fully collapsed, volume phase transition is reversed by locally cooling the gel from the same end that was first heated. This is accomplished by using the first one or two Peltier elements in contact with the first end of the collapsed gel to cause cooling to provide sufficient cooling length for the butting described later, while the next Peltier elements are kept at a temperature above the transition temperature of the gel. The cooled end of the gel swells until it butts against the glass wall of the tube and anchors the first end of the gel structure to the glass wall by applying pressure against the wall of the tube. The collapsed part of the gel is not hindered by the glass wall and moves. Then the next 1 or 2 Peltier elements (to provide sufficient cooling length for the purpose described) are switched to cooling mode and so on, so swelling propagates to the right along the gel and the center of mass continues moving in the same direction until the gel is fully swelled. The sequence of events is then repeated. As a result gel movement is induced in a selected direction by anisotropically applying volume phase transition along the length of the gel by applying stimuli locally and progressively in the direction selected forcing phase transition to propagate along the length of the gel in the selected direction.

In one variation of the invention, the gel structure 62 has a drug entrapped therein which by movement of the center of mass of the gel structure is propelled from glass tube 60 in the gel structure for introduction or injection into a patient for controlled or sustained release of the drug in the patient. For this utility, the drugs may be reacted with free carboxyls in monomer for example, with free carboxyl in N-isopropylacrylamide before cross-linking to form polymer gel to form covalent bonds between drug and the monomer or the drug can be physically encapsulated or entrapped by the monomer and thereafter by the gel formed from the monomer. The drug is released by metabolic action in the patient's body and the attachment to or entrapment in or encapsulation with gel delays release, for example, for 2 to 48 hours or more. For example with a channel of 1 μm diameter, the hydrogel with drug therein might be propelled into the patient with speeds on the order of meters per second. Sufficiently small passageways implement velocities sufficient to inject materials though cellular membranes, including skin. To make sure that the gel is expelled from the tube completely, as the front end of the gel is out and in the target, the heating elements opposite tube 60 can be turned on quickly to ensure that the last segment of the gel is collapsed; the elastic properties of the gel will insure that the last segment of the gel will follow the rest. Alternatively, a segmented gel can be employed with a mechanism to separate the last portion of the gel from the rest.

Figure 3:
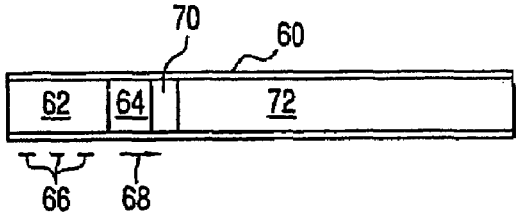
FIG. 3 is a schematic representation of an example of the first embodiment used to move a piston, depicted in longitudinal cross-section.

With reference to FIG. 3, glass tube 60 contains gel 62 and body of fluid 64 and Peltier elements are schematically represented at 66 and continue along the length of the tube as indicated by arrow 68 and are successively switched on to provide heating and gel collapse and then cooling and gel swelling to propagate gel movement in the direction of arrow 68. A difference between FIG. 3 and FIG. 2 is that the glass tube 60 contains a piston 70 and body of liquid 72 downstream of the piston, e.g., a sample to be analyzed, and the apparatus of FIG. 3 is used to drive piston 70 to propel sample 72, for example, on a microchip for analysis, or containing a drug to be expelled for administration. For this purpose, the glass tube can have a transverse cross-section diameter, ranging, for example, from microns to millimeters for a circular transverse cross-section tube. Another difference from the operation of FIG. 2 is that there is a liquid inlet (not shown) to supply liquid back of piston 70 as it moves forward.

Figure 4:
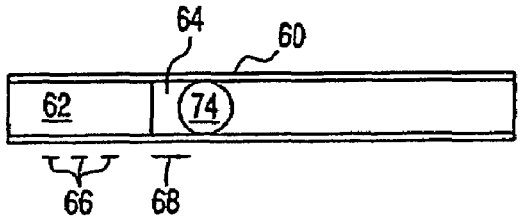
FIG. 4 is a schematic representation of an example of the first embodiment used to move a load different from a piston, depicted in longitudinal cross-section.

With reference to FIG. 4, the scenario is the same as for FIG. 2 with glass tube 60, reversibly collapsible gel 62, a solvent 64, Peltier elements 66 and scenario as indicated by arrow 68. The difference is that the tube 60 contains a load 74, e.g., a medical device to be inserted, in a tissue or body cavity. After the device is inserted, the gel is caused to retract into the tube by reversing the direction of movement of the gel. While the load is shown as filling the cross section of the channel of tube 60, it can be of lesser cross section than that of the channel of tube 60 so liquid downstream of the load will leak around the load as the gel moves it forward. In the case where the load has the same cross section as the tube 60, a liquid inlet (not shown) is provided to supply liquid back of the load as it is moved forward. The load 74 can be of any shape.

Figure 5:
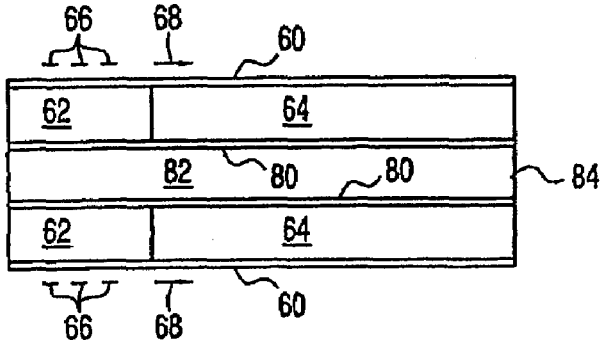
FIG. 5 is a schematic representation of the second example of the first embodiment herein, depicted in longitudinal cross-section.

With reference to FIG. 5, there is schematically depicted the second example of the first embodiment. With continuing reference to FIG. 5, there is depicted an annular structure with outer glass wall 60 and inner flexible wall tube 80, for example, made of rubber, with the annulus defined by relative position of tube 60 and tube 80 containing hydrogel 62 and solvent 64 with heating and cooling scenario shown at 66 and 68. The tube 80 contains a fluid 82 to be propelled. Induction of volume phase transition in gel 62 in the direction of arrow 68 flexes the wall of tube 80 and alternately causes it to expand and contract in sinusoidal fashion to propel the fluid 82 through tube 80 and out of opening 84 thereof. The stimuli are applied , for example, to cause the gel to assume a dumbbell shape to impart sine wave configuration to the encasing annular structure and movement of the sine wave configuration progressively along wall 80 to move fluid 82 through the opening 84.

So far as FIGS. 2, 3 and 4 are concerned, liquid 64 is provided to provide liquid for uptake into the gel.

So far as the tube 60 is concerned for FIGS. 2 and 4, in cases where liquid forward of the gel reconstitutes the gel, the length of the tube should be so much larger than the length of the gel that the amount of liquid in the tube can be considered infinite.

With reference to FIG. 6, there is depicted a device that is a housing 86 with reversibly collapsible gel 62 together with water in a flexible sack or flexible sacks (not shown) attached to the outer surface of the housing with small reservoirs (not shown) within the device where water will be transferred as it is expelled from the gel so there is a change in volume in the sack or sacks so there will be waves and movement of the device as the gel undergoes phase transition. The housing 86 contains an internal power supply 88, Peltier elements 89, and electronics 90 to control the Peltier elements, to apply stimulation to the gel to control swelling and collapsing. The housing 86 also contains a load or cargo 91, which is a microchip or a capsule with a drug that is for delivery at a certain point or a digital camera or miniature recording equipment for investigation. The device is positioned, for example, in an intestine 92 and inner surface of the intestine serves as the confining passageway. Collapsing and swelling are successively carried out in the direction of desired movement to move the housing in the intestine to where the load is required. The device will be a rather large device for intestinal use; however, the gel structure can be one structure or a plurality of structures acting in synch.

Alternatively, the device can touch only part of the intestinal wall and the waves in the gel will move it along the wall without confining passageways.

To control free motion of a similar device in a liquid environment, independently controlled sack of gel can be provided on each side of the device, preferably on four sides and waves in each sack are modulated to change the velocity vector of one side relative to other sides. For example, on a symmetrical device, all sides operating in synch provide straight ahead motion. To turn, opposite sides are modulated, one side with faster waves, one side with slower waves. To turn quickly, the waves on one side are eliminated and the waves on the opposite side are implemented opposite to the direction of turn.

With reference to FIG. 7E, there is shown in cross section a vesicle (e.g., a (microrobotic machine)) with flexible membrane 71 housing heating elements 73, power supply 75, electronics (not shown) and load 77 with a reversibly collapsible polymerized gel 62 deposited thereon. The vesicle is immersed in a fluid, e.g., a liquid, and the electronics control the swelling/shrinking scenario to cause the vesicle to assume a succession of shapes as shown in FIGS. 7A, 7B, 7C and 7D to provide self propelling movement. If the vesicles are sufficiently small, they can be used in veins/arteries without significantly obstructing blood flow. Larger scale vesicles can be used for marine/fresh water explorations. An important feature of these devices is that they do not require a confining passageway to move, yet their movement is still based on anisotropic volume phase transition. The self propelling movement can be, for example, purely rectilinear, or with rotation. Rotational deformation of the vesicle can be induced by polymerizing gel in the vesicle surface in non-spatially homogeneous arrangement, e.g., in "stripes" about the body of the vesicle.

A self-propelling vesicle can also be implemented by integrating electroconductive polymers within gel structure (e.g., within a thermally sensitive gel structure) so that when current from a power supply, e.g., a battery or super capacitor, passes through the electroconductive polymer, heat is generated due to resistance which affects the thermosensitive characteristic of the gel. Alternatively an electroconductive gel can be used where volume phase transition is effected by electric current.

In another case, a self-propelling vesicle contains a supply of ions in gel therein with channels/pumps in communication to outside the gel with the ions preferentially passing through the channels to and from the gel to induce volume phase transition. In this case volume change is induced by change in ionic content of the gel (instead of temperature change). The gels used are, for example, polyelectrolyte gels.

Figure 8:
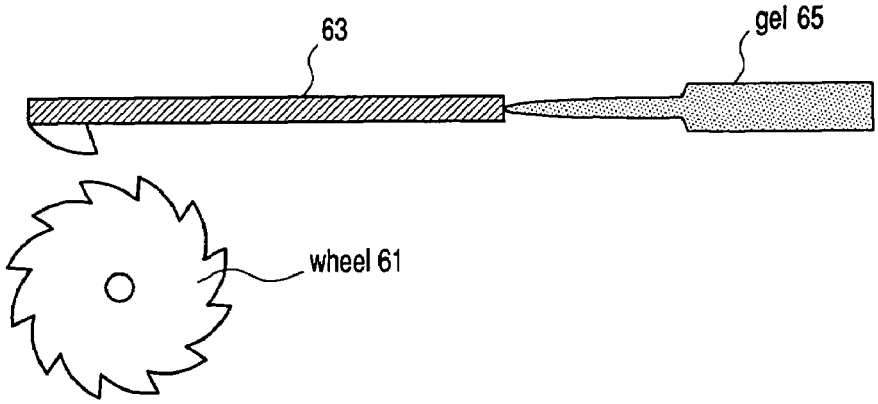
FIG. 8 depicts a gel volume phase transition driven ratchet mechanism for imparting rotary motion.

With reference to FIG. 8, there is shown a ratchet mechanism with a notched wheel 61 and a downwardly biased pawl 63. A reversibly collapsible gel 65 is anchored at its right end to an immobile surface and its left end is attached to the pawl 63. As the gel is swollen, the gel is moved to the left to move the pawl to the left whereupon the downward biasing causes the pawl to hook onto a tooth of wheel 61. As the gel is collapsed, it drags the pawl causing the wheel 61 to move clockwise.

The invention is also useful for load transport in microfluidic devices where the locomotion is controlled by embedded stimuli that locally heat/cool the gel.

We turn now to a case of a device for moving a load which relies on and comprises a plurality of gel structures of smaller scale than the load. The load can be of any size, e.g., from micron-scale centimeter or larger-scale, and the individual gel structures need only be enough smaller than the load that the plurality of gel structures can simultaneously apply a force to the load.

Small diameter gels, e.g., confined in tubes of small diameter, have much faster volume phase transition times than gels of larger diameter since the reaction time of a gel is largely cross-section determined, and therefore move/react to stimulation extremely rapidly. Since gel volume changes are diffusion controlled, miniaturization to the micrometer scale will dramatically increase gel speeds beyond what has currently been observed. To take advantage of these effects and increase the speed at which a load is moved, a plurality of confined smaller diameter gels, e.g., each being of diameter or transverse dimension on the order of microns, e.g., 1-50 microns, or even less than 1 micron as enabled by published information and available technology, are operated in synchronization to obtain the fast propulsion effects of small dimension gels for propelling the larger load. Even smaller diameter generates a small force and the plurality of small forces are such as to move the load; the size and location of each small diameter gel (force applicator) is determined by size constraints. For example, with a load having a radius three times that of a gel structure (assuming circular cross-section), e.g., 3 microns, 5-9 gel structures of radius 1 micron might be used to push against the load. Below is a table of radius versus circular cross-section for comparison:

TABLE

| Radius | Circular Cross-Section |
|---|---|
| 1 | 3.1 |
| 2 | 12.6 |
| 3 | 28.3 |
| 4 | 50.3 |
| 5 | 78.5 |
| 6 | 113.1 |
| 7 | 153.9 |
| 8 | 201.1 |
| 9 | 254.5 |
| 10 | 314.2 |
| 11 | 380.1 |
| 12 | 452.4 |
| 13 | 530.9 |
| 14 | 615.8 |
| 15 | 706.9 |

As is evident from the above, this embodiment is not limited to application to large loads, but can also be used with small radius loads in combination with even smaller radius gel structures. For example, one might move a 100 micron radius load very fast using 100 or 1,000 one-micron radius gels to push it. The requirement is that the plurality of gel structures together have a cross section equal to or less than that of the load. With speed up being non-linear with cross-section reduction, using two structures containing the same amount of gel as a single structure will result in movement that is more than twice as fast. This embodiment is useful, for example, to provide a compartmented element (e.g., with a plurality of small diameter compartments) with each compartment containing gel, used for example, to move a video device, e.g., for gastrointestinal examinations.

To obtain movement of a gel with increased precision, an initial position of swollen gel structure is collapsed and then swelled before a succeeding portion of the gel structure is collapsed, so that the entire body of gel structure is not collapsed or swollen at one time, e.g., similar to worm motion.

The invention herein is useful in respect to microelectromechanical systems (MEMS) and nanoelectromechanical systems (NEMS). An important benefit in this context, is that the invention can cause velocities in the scale of these systems to increase dramatically. As indicated above, the speeds of gel movement obtained can be on the order of meters per second, which is much faster than movement on a similar scale in biological organisms.

Methods to incorporate micrometer-sized gels in MEMS and microfluidic channels already exist, and motion control can be achieved using resistive heating. See Huber, D. L., et al., Science 301, 352 (2003) and Liu, R. H., J. Microelectromech. Syst. 11, 45, (2002). The properties of hydeogels as building materials for MEMs have been addressed by Harmon, M. E., et al., Polymer 44, 4547 (2003). As opposed to molecular-motor-based hybrid devices that can be operated only in bulk, each gel device can be manipulated individually with a precision determined by the size of heating elements.

VARIATIONS

The foregoing description of the invention has been presented describing certain operable and preferred embodiments. It is not intended that the invention should be so limited since variations and modifications thereof will be obvious to those skilled in the art, all of which are within the spirit and scope of the invention.

What is claimed is:

1. A method for propagating movement of an elongated gel structure comprising a gel and having a first end and an other end, in the direction of its length;

where the elongated gel structure has an aspect ratio greater than 1, where the length dimension is greater than the transverse dimension; comprising the steps of:

(a) providing an elongated confining passageway defined by at least one wall and having an entrance end and an exit end longitudinally removed from one another, and a transverse dimension, (b) providing in a minor portion of the passageway a swollen reversibly collapsible gel structure, so that the gel structure is confined by said at least one wall and has a first end and an other end longitudinally removed from said first end, (c) applying stimuli to the confined gel structure starting at its first end and then successively along its length to progressively induce a volume phase transition from said first end along the length of the gel structure to progressively collapse said gel structure and move the center of mass of the gel structure toward said exit end and provide a gel structure of reduced volume compared to that of step (b) having a first end longitudinally moved toward said exit end and an other end longitudinally positioned about the same as the other end in step (b), (d) applying stimuli to the reduced volume gel structure at its moved first end to induce volume phase transition and swelling at said moved first end to swell the moved first end in a transverse direction to anchor the gel structure to said at least one wall at said moved first end and also to swell the gel structure at the moved first end in a longitudinal direction and to move the other end of the gel structure toward the exit end of the confining passageway and successively applying stimuli along the length of the reduced volume gel structure to progressively induce volume phase transition to swell the gel structure along its entire length, thereby causing movement of the center of mass of the gel structure toward said exit end;

where the gel of the gel structure is a poly-N-isopropylacrylamide hydrogel and the stimuli to induce the volume phase transition involving collapsing comprise application of a temperature above the transition temperature of the hydrogel and the stimuli to induce volume phase transition involving swelling comprising application of a temperature below the transition temperature of the hydrogel;

and where the gel structure includes from 0.02 to 0.25% stiffening agent.

2. The method of claim 1 where the stiffening agent is a polysaccharide.

3. The method of claim 2 where the polysaccharide is dextran.

* * * * *

UNITED STATES PATENT AND TRADEMARK OFFICE

CERTIFICATE OF CORRECTION

PATENT NO. : 7,600,378 B2
APPLICATION NO. : 11/166164
DATED : October 13, 2009
INVENTOR(S) : Yeghiazarian et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1143 days.

Signed and Sealed this

Fifth Day of October, 2010

David J. Kappos

David J. Kappos
*Director of the United States Patent and Trademark Office*